US005590698A

United States Patent [19]

Whitley et al.

[11] Patent Number: 5,590,698

[45] Date of Patent: Jan. 7, 1997

[54] SPILL RECOVERY FILL SPOUT

[75] Inventors: Gerald E. Whitley; Mary F. Whitley, both of Grimesland, N.C.

[73] Assignee: Gerald Whitley, Grimesland, N.C.

[21] Appl. No.: 523,241

[22] Filed: Sep. 5, 1995

[51] Int. Cl.[6] ..... B65B 1/04; B65B 3/04

[52] U.S. Cl. ..... 141/98; 141/86; 141/286; 141/332

[58] Field of Search ..... 141/98, 86, 285, 141/286, 311 A, 331, 332, 333, 339, 340, 341, 297, 298, 299, 300; 220/86.2

[56] References Cited

U.S. PATENT DOCUMENTS 706,465 8/1902 Legier ..... 141/297
1,705,312 3/1929 Rovano ..... 141/340
2,065,390 12/1936 Mulch ..... 141/298
4,526,216 7/1985 Lake, Jr. ..... 141/286
4,615,362 10/1986 Hartman et al. ..... 141/86

*Primary Examiner*—Henry J. Recla
*Assistant Examiner*—Steven O. Douglas

[57] ABSTRACT

A fill spout that allows you to fill a liquid fuel tank. This design allows you to recapture overfill regardless of ovenrun or overfill running backward up the vent tube in most of today's tanks, thus, helping to prevent petroleum spills.

1 Claim, 3 Drawing Sheets

SPILL RECOVERY FILL SPOUT

BACKGROUND OF THE INVENTION

The present invention relates to the modification of the spout used to put fuel into vessels and vehicles to provide for the recovery of potential spills. The invention relates to an individual system for fuel filling of vessels and vehicles. One of the problems with a large percentage of vessels is the location and type of fill spout used and the relationship with the venting apparatus. A vast majority of the time the vent is below the top of the fill spout. In some cases, it can be as much as one or more feet lower. This relationship causes overfill to vent to the outside of the vessel, resulting in a petroleum spill. Federal regulations require venting to the outside of the vessel, thereby decreasing the chance of fire. It is extremely difficult to avoid overfilling many vessels where the level of the fuel cannot be determined until it reaches the top of the fill spout. This leaves some fuel in the fill spout above the vent exit, which results in fuel being vented to the outside of the vessel. This causes repeated small petroleum spills, which have a significant cumulative negative effect on the environment. The frequency and extent of such spills both increase in cases where operators are handicapped or otherwise impaired (by alcohol, etc.).

Minor overfills occur frequently when fueling a vehicle. It is therefore, the object of the present invention to provide a means of recovering small spills caused by the general public. This device would also supplement current spill avoidance methods, e.g., auto cutoff nozzles, by providing two possibilities for preventing petroleum spills: 1) the cut off nozzle and 2) the present invention to catch possible overfill or spray-back. Implementation of this invention will in no way alter the present means of fueling a vehicle or vessel.

The total objective and advantages of the proposed invention will become apparent through the study of the following descriptions and drawings. The drawings have been provided merely to illustrate the basic concept of the present invention.

SUMMARY OF THE INVENTION

The present invention relates to a simple fill spout that recovers potential small fuel spills. The invention is designed such that it can be used by anyone that is presently fueling vessels or vehicles with current normal fueling procedures.

The invention has a recovery tank that catches overfill often experienced while fueling a vehicle or vessel. It also provides a means for venting into the recovery tank the fumes from the tank being filled. When implemented in vessels, a vent pipe is added to the outside from the recovery tank in order to decrease the chance of fire.

BRIEF DESCRIPTION OF THE DRAWINGS

The following drawings form part of the specifications and illustrate various parts of the present invention. The parts of this invention will be referred to by numerals where possible, in order to relate like parts in the various views.

DETAILED DESCRIPTION OF THE DRAWINGS

Figure 1:
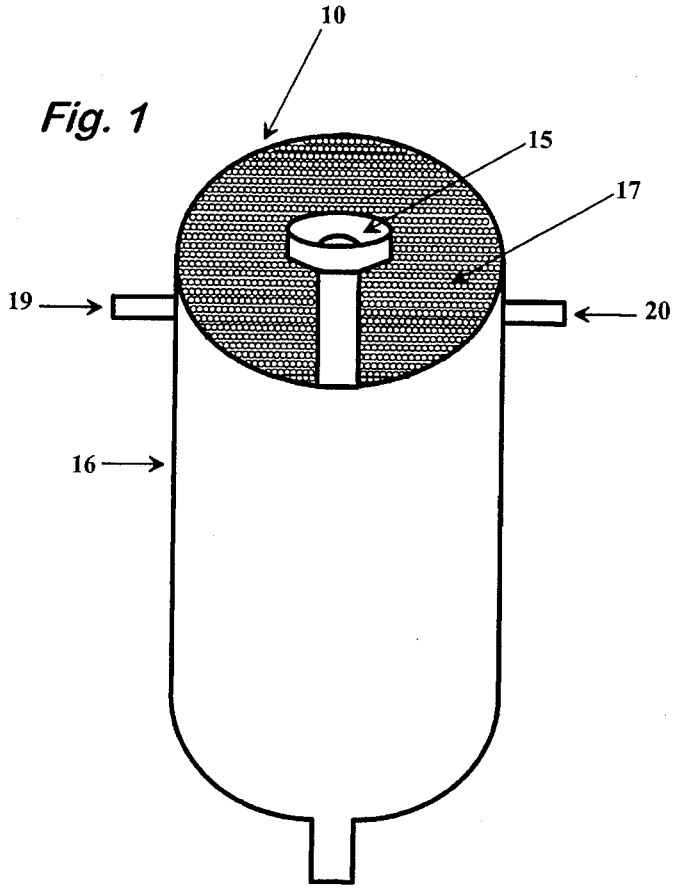
FIG. 1 is a fragmentary isometric angled front view of the fill spout.
Figure 2:
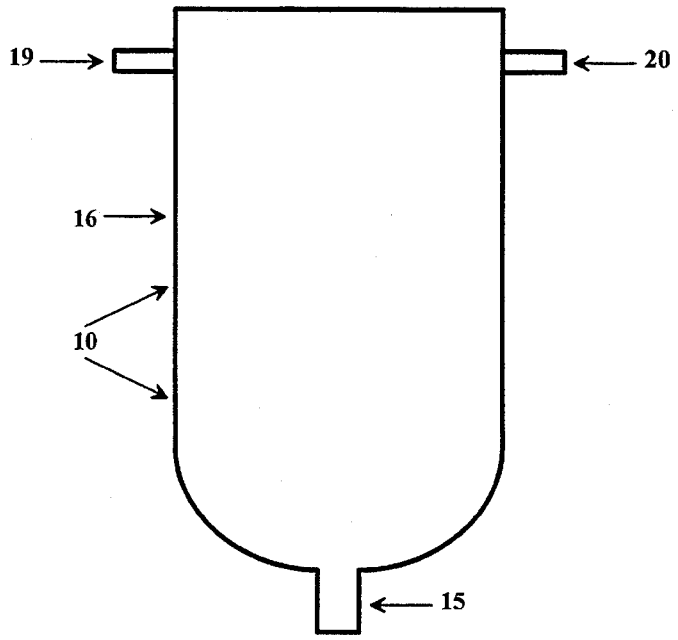
FIG. 2 is a fragmentary isometric front view of the fill spout.

With further reference to the drawings, in particular FIG. 1 and FIG. 2, the spill recovery fill spout (the present invention) is identified generally by the numeral 10. The present invention modifies and adds to the present means of filling libel tanks in general. This invention may be used on vessels or vehicles.

Figure 3:
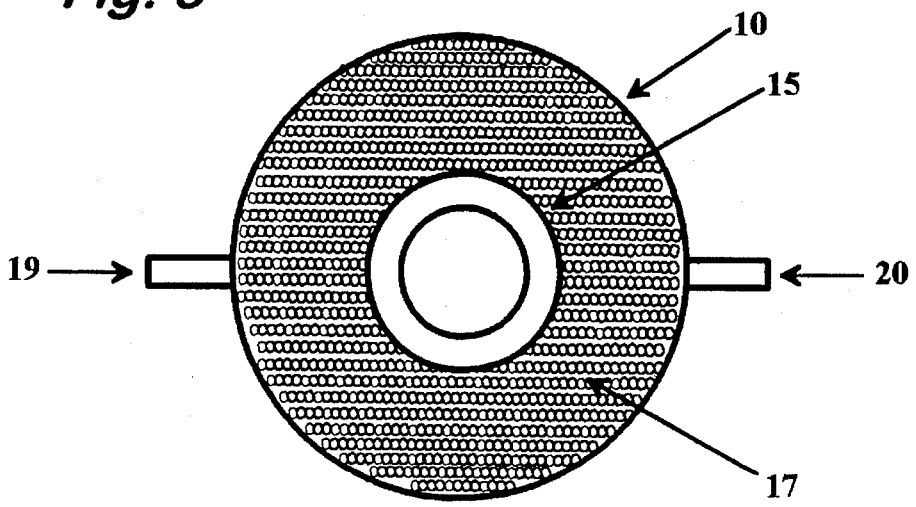
FIG. 3 is a fragmentary isometric top view of the fill spout using a screen support.
Figure 4:
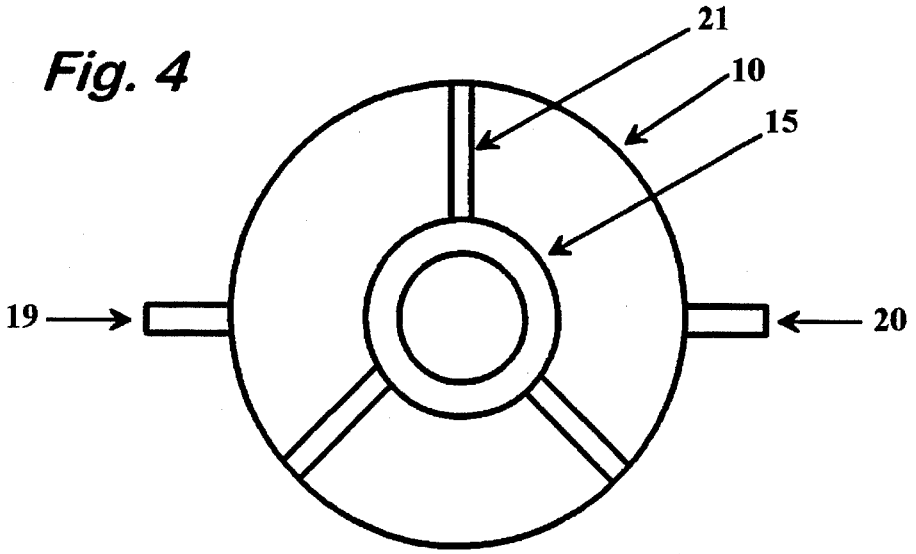
FIG. 4 is a fragmentary isometric top view of the fill spout using a truss support.
Figure 5:
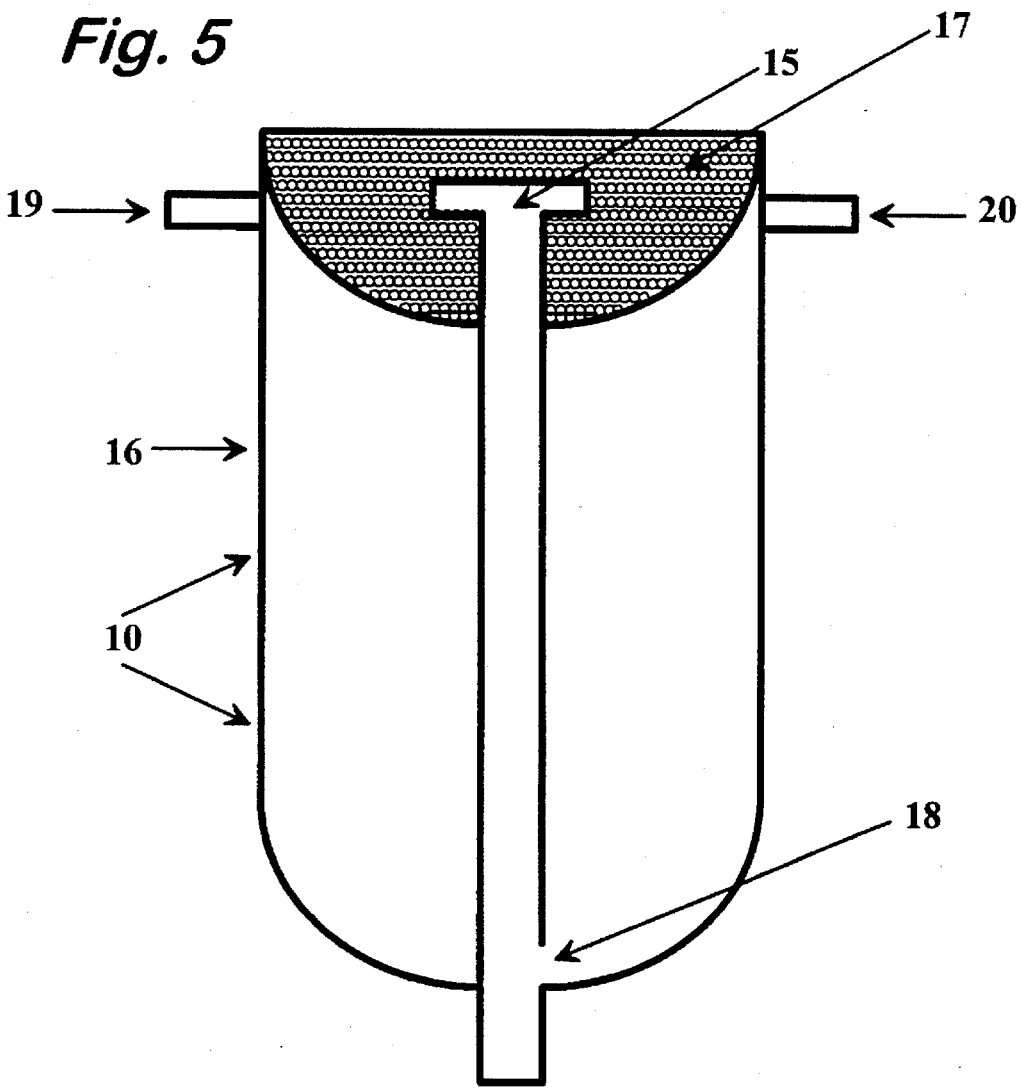
FIG. 5 is a fragmentary cut away view through center of fill spout.

Fill spout 10 employs a recapture tank 16 to contain overfill or spray-back. When the fuel tank is full, fuel will back up in fill pipe 15 causing fuel to run over into concave perforated screen 17. This in turn allows the fuel to flow into the recapture tank 16. Holes in perforated screen 17 should be smaller than hole 18 in fill pipe 15, to prevent debris from clogging hole 18 and prevent fuel from returning to fill pipe 15. The invention may omit perforated screen 17, and in this case the invention would have supports 21 to hold fill pipe 15 centered in holding tank 16 as shown in FIG. 3, achieving the same results. Fuel captured into holding tank 16 is then allowed to return to fill pipe 15 through a hole 18, returning recaptured fuel to the fuel tank.

Continuing to refer to the drawings one sees that there are two vent pipes, 19 and 20. When used in vehicles, one pipe would vent fumes from the tank being filled and the other would be sealed off. While in vessels, one vent pipe, 19 or 20, would be used to vent fumes from the tank as it is filled. This would put fumes into recapture tank 16. This has to be vented to the outside of the vessel using one of the pipes, 19 or 20, depending on which would be more feasible.

The spill recovery fill spout may be shaped differently than shown in the drawings in order to fit the desired application. Drawings shown have a rounded recapture tank 16. This tank could be rectangular or oval and its size could vary from rather small to rather large.

I claim:

1. A spill recovery fill spout for use in refueling vessels, comprising:

a cylindrical fill spout having an open upper end adapted to receive the fill spout of a refueling nozzle, an open lower end, a sidewall extending between the upper and lower ends and a hole disposed in the sidewall;

a recapture tank surrounding a portion of the cylindrical fill spout, and having an open upper end and a lower end attached to the cylindrical fill spout at a point below said hole;

at least one horizontally disposed vent pipe attached to said recapture tank to vent the interior thereof; and a concave perforated screen attached to the open upper end of said recapture tank and terminating at a point along the upper portion of said fill spout to prevent debris from entering the recapture tank and clogging said hole;

wherein, during filling, overfill and spray-back fuel is collected by the recapture tank and returned to the vessel via said hole.

* * * * *